US008840009B2

(12) United States Patent
Spivey, Sr. et al.

(10) Patent No.: US 8,840,009 B2
(45) Date of Patent: Sep. 23, 2014

(54) CARTON WITH HANDLE

(71) Applicants: Graphic Packaging International, Inc., Atlanta, GA (US); Adalis Corporation, Vancouver, WA (US)

(72) Inventors: Raymond R. Spivey, Sr., Mableton, GA (US); Robert L. Sutherland, Kennesaw, GA (US); Ronnie J. Huff, Auburn, AL (US)

(73) Assignees: Graphic Packaging International, Inc., Atlanta, GA (US); Adalis Corporation, Vancouver, WA (US)

( * ) Notice: Subject to any disclaimer, the term of this patent is extended or adjusted under 35 U.S.C. 154(b) by 0 days.

(21) Appl. No.: 13/762,804

(22) Filed: Feb. 8, 2013

(65) Prior Publication Data

US 2013/0146649 A1 Jun. 13, 2013

Related U.S. Application Data

(63) Continuation of application No. PCT/US2011/051897, filed on Sep. 16, 2011.

(60) Provisional application No. 61/403,549, filed on Sep. 17, 2010.

(51) Int. Cl.

| | |
|---|---|
| ***B65D 5/42*** | (2006.01) |
| ***B31B 49/02*** | (2006.01) |
| ***B65D 71/36*** | (2006.01) |

(52) U.S. Cl.

CPC ..... *B65D 5/4208* (2013.01); *B65D 2571/0053* (2013.01); *B65D 2571/00524* (2013.01); *B65D 2571/00728* (2013.01); *B65D 2571/00141* (2013.01); *B65D 2571/0066* (2013.01); *B65D 71/36* (2013.01); *B65D 2571/00469* (2013.01); *B31B 49/02* (2013.01); *B65D 2571/00549* (2013.01)

USPC ..... 229/117.13; 493/137

(58) Field of Classification Search

USPC ..... 229/117.13, 117.12, 920; 493/137

See application file for complete search history.

(56) References Cited

U.S. PATENT DOCUMENTS

| | | | |
|---|---|---|---|
| 1,253,193 | A | 1/1918 | Hill |
| 2,372,351 | A | 3/1945 | Arneson |

(Continued)

FOREIGN PATENT DOCUMENTS

| | | |
|---|---|---|
| CA | 740309 | 8/1966 |
| CA | 877792 | 8/1971 |

(Continued)

OTHER PUBLICATIONS

International Search Report and Written Opinion for PCT/US2011/051897 dated Apr. 24, 2012.

*Primary Examiner* — Gary Elkins
*Assistant Examiner* — Christopher Demeree
(74) *Attorney, Agent, or Firm* — Womble Carlyle Sandridge & Rice, LLP

(57) ABSTRACT

A carton for containing a plurality of articles. The carton comprises a plurality of panels that extends at least partially around an interior of the carton. The plurality of panels comprises a first top panel, a second top panel, a bottom panel, a first side panel, and a second side panel. The first top panel and the second top panel are at least partially overlapped to form a top wall of the carton. A handle extends in at least the top wall. The handle can comprise at least a first handle portion of the first top panel and a second handle portion of the second top panel. The first handle portion can at least partially overlap the second handle portion, and the second handle portion can comprise a notch that is at least partially overlapped by an overlay portion of the first handle portion.

40 Claims, 13 Drawing Sheets

(56) References Cited

U.S. PATENT DOCUMENTS

| | | | |
|---|---|---|---|
| 2,383,183 | A | 8/1945 | Fischer |
| 2,482,399 | A | 9/1949 | Bullock |
| 2,594,376 | A | 4/1952 | Arneson |
| 2,702,144 | A | 2/1955 | Forrer |
| 2,797,856 | A | 7/1957 | Jaeschke |
| 2,810,506 | A | 10/1957 | Kessler |
| 2,851,210 | A | 9/1958 | Kramer et al. |
| 2,868,433 | A | 1/1959 | Anderson, Jr. |
| 2,896,838 | A | 7/1959 | Struble |
| 2,955,739 | A | 10/1960 | Collura |
| 3,094,268 | A | 6/1963 | Swanson et al. |
| 3,112,856 | A | 12/1963 | MacIntosh et al. |
| 3,127,720 | A | 4/1964 | Gentry et al. |
| 3,204,815 | A | 9/1965 | Weiss |
| 3,300,119 | A | 1/1967 | Chaussadas |
| 3,309,005 | A | 3/1967 | Pilger |
| 3,334,767 | A | 8/1967 | Cornelius et al. |
| 3,355,012 | A | 11/1967 | Weiss |
| 3,367,557 | A | 2/1968 | Farguhar |
| 3,371,846 | A | 3/1968 | Detzel |
| 3,381,881 | A | 5/1968 | Granz et al. |
| 3,797,729 | A | 3/1974 | Holmes |
| 3,827,550 | A | 8/1974 | Arneson |
| 3,828,926 | A | 8/1974 | Rossi |
| 3,886,901 | A | 6/1975 | Zeitler |
| 3,894,681 | A | 7/1975 | Arneson et al. |
| 3,904,036 | A | 9/1975 | Forrer |
| 3,933,303 | A | 1/1976 | Kirby, Jr. |
| 3,955,748 | A | 5/1976 | Calvert |
| 3,994,432 | A | 11/1976 | Kirby, Jr. |
| 4,029,204 | A | 6/1977 | Manizza |
| 4,032,218 | A | 6/1977 | Scheffer |
| 4,036,423 | A | 7/1977 | Gordon |
| 4,093,116 | A | 6/1978 | Watkins et al. |
| 4,096,985 | A | 6/1978 | Wood |
| 4,111,306 | A | 9/1978 | Roccaforte |
| 4,215,781 | A | 8/1980 | Humphries et al. |
| 4,216,861 | A | 8/1980 | Oliff |
| 4,318,474 | A | 3/1982 | Hasegawa |
| 4,327,829 | A | 5/1982 | Hughes |
| 4,328,923 | A | 5/1982 | Graser |
| 4,329,923 | A | 5/1982 | Iida |
| 4,331,289 | A | 5/1982 | Killy |
| 4,364,509 | A | 12/1982 | Holley et al. |
| 4,375,258 | A | 3/1983 | Crayne et al. |
| 4,378,905 | A | 4/1983 | Roccaforte |
| 4,382,505 | A | 5/1983 | Sutherland et al. |
| 4,405,078 | A | 9/1983 | Dutcher et al. |
| 4,424,901 | A | 1/1984 | Lanier |
| 4,440,340 | A | 4/1984 | Bakx |
| 4,447,004 | A | 5/1984 | House et al. |
| 4,478,334 | A | 10/1984 | Graser |
| 4,498,581 | A | 2/1985 | Dutcher |
| 4,498,619 | A | 2/1985 | Roccaforte |
| 4,508,258 | A | 4/1985 | Graser |
| 4,538,759 | A | 9/1985 | Dutcher |
| 4,545,485 | A | 10/1985 | Oliff |
| 4,546,914 | A | 10/1985 | Roccaforte |
| 4,577,799 | A | 3/1986 | Oliff |
| 4,588,084 | A | 5/1986 | Holley, Jr. |
| 4,653,686 | A | 3/1987 | Wood et al. |
| 4,706,876 | A | 11/1987 | Wilson |
| 4,712,728 | A | 12/1987 | Schuster |
| 4,747,487 | A | 5/1988 | Wood |
| 4,784,266 | A | 11/1988 | Chaussadas |
| 4,784,316 | A | 11/1988 | Crouch |
| 4,802,583 | A | 2/1989 | Calvert et al. |
| 4,830,267 | A | 5/1989 | Wilson |
| 4,838,479 | A | 6/1989 | Wood |
| 4,875,586 | A | 10/1989 | Chaussadas |
| 4,966,324 | A | 10/1990 | Steel |
| 4,989,778 | A | 2/1991 | Saulas |
| 5,020,337 | A | 6/1991 | Krieg |
| 5,060,792 | A | 10/1991 | Oliff |
| 5,094,359 | A | 3/1992 | DeMars et al. |
| 5,106,014 | A | 4/1992 | Miller |
| 5,119,985 | A | 6/1992 | Dawson et al. |
| 5,197,598 | A | 3/1993 | Stout et al. |
| 5,221,041 | A | 6/1993 | Stout et al. |
| 5,222,658 | A | 6/1993 | DeMaio et al. |
| 5,234,102 | A | 8/1993 | Schuster et al. |
| 5,246,112 | A | 9/1993 | Stout et al. |
| 5,284,294 | A | 2/1994 | Floyd |
| 5,292,058 | A | 3/1994 | Zoss et al. |
| 5,297,725 | A | 3/1994 | Sutherland |
| 5,303,863 | A | 4/1994 | Arasim |
| 5,307,932 | A | 5/1994 | Stout et al. |
| 5,307,986 | A | 5/1994 | Schuster |
| 5,320,277 | A | 6/1994 | Stout et al. |
| 5,333,734 | A | 8/1994 | Stout et al. |
| 5,379,944 | A | 1/1995 | Stout et al. |
| 5,381,891 | A | 1/1995 | Harris |
| 5,385,234 | A | 1/1995 | Stout et al. |
| 5,395,044 | A | 3/1995 | Stout |
| 5,427,241 | A | 6/1995 | Sutherland |
| 5,427,307 | A | 6/1995 | Campbell |
| 5,458,234 | A | 10/1995 | Harris |
| 5,472,090 | A | 12/1995 | Sutherland |
| 5,480,091 | A | 1/1996 | Stout |
| 5,482,203 | A | 1/1996 | Stout |
| 5,485,915 | A | 1/1996 | Harris |
| 5,495,727 | A | 3/1996 | Strong et al. |
| 5,524,756 | A | 6/1996 | Sutherland |
| 5,551,556 | A | 9/1996 | Sutherland |
| 5,582,343 | A | 12/1996 | Dalvey |
| 5,593,027 | A | 1/1997 | Sutherland |
| 5,639,017 | A | 6/1997 | Fogle |
| 5,647,483 | A | 7/1997 | Harris |
| 5,669,500 | A | 9/1997 | Sutherland |
| 5,699,957 | A | 12/1997 | Bin et al. |
| 5,704,470 | A | 1/1998 | Sutherland |
| 5,738,273 | A | 4/1998 | Auclair |
| 5,739,273 | A | 4/1998 | Engelman et al. |
| 5,794,778 | A | 8/1998 | Harris |
| 5,826,782 | A | 10/1998 | Stout |
| 5,873,515 | A | 2/1999 | Dunn et al. |
| 5,878,946 | A | 3/1999 | Frerot et al. |
| 5,915,546 | A | 6/1999 | Harrelson |
| 5,992,733 | A | 11/1999 | Gomes |
| 5,996,883 | A | 12/1999 | Bates |
| 6,019,276 | A | 2/2000 | Auclair |
| 6,021,897 | A | 2/2000 | Sutherland |
| 6,065,590 | A | 5/2000 | Spivey |
| 6,085,969 | A | 7/2000 | Burgoyne |
| 6,105,853 | A | 8/2000 | Lamare |
| 6,105,854 | A | 8/2000 | Spivey et al. |
| 6,112,977 | A | 9/2000 | Sutherland et al. |
| 6,129,266 | A | 10/2000 | Oliff et al. |
| 6,131,803 | A | 10/2000 | Oliff et al. |
| 6,164,526 | A | 12/2000 | Dalvey |
| 6,170,741 | B1 | 1/2001 | Skolik et al. |
| 6,227,367 | B1 | 5/2001 | Harrelson et al. |
| 6,260,755 | B1 | 7/2001 | Bates et al. |
| 6,302,320 | B1 | 10/2001 | Stout |
| D452,154 | S | 12/2001 | Rhodes et al. |
| 6,425,520 | B1 | 7/2002 | Peterson |
| 6,523,739 | B2 | 2/2003 | Heeley et al. |
| 6,631,803 | B2 | 10/2003 | Rhodes et al. |
| 6,758,337 | B2 | 7/2004 | Chargueraud et al. |
| 6,766,940 | B2 * | 7/2004 | Negelen ..... 229/117.13 |
| 6,834,793 | B2 | 12/2004 | Sutherland |
| 6,848,573 | B2 | 2/2005 | Gould et al. |
| 6,869,009 | B2 | 3/2005 | Sutherland et al. |
| 6,899,221 | B2 | 5/2005 | Skolik et al. |
| 6,905,066 | B2 | 6/2005 | Holley et al. |
| 6,926,193 | B2 | 8/2005 | Smalley |
| 6,945,450 | B2 | 9/2005 | Rusnock |
| 7,007,836 | B2 * | 3/2006 | Smalley ..... 229/117.13 |
| 7,234,596 | B2 | 6/2007 | Lebras |
| 7,296,731 | B2 | 11/2007 | Auclair et al. |
| 7,380,701 | B2 | 6/2008 | Fogle et al. |
| 7,416,109 | B2 | 8/2008 | Sutherland |
| 7,427,010 | B2 | 9/2008 | Sutherland |
| 7,472,791 | B2 | 1/2009 | Spivey, Sr. |

(56) References Cited

U.S. PATENT DOCUMENTS

| | | | |
|---|---|---|---|
| 7,601,111 | B2 | 10/2009 | Sutherland et al. |
| 7,699,215 | B2 | 4/2010 | Spivey, Sr. |
| 7,743,944 | B2 | 6/2010 | Ho Fung et al. |
| 7,743,968 | B2 | 6/2010 | Theelen |
| 7,748,603 | B2 | 7/2010 | Fogle et al. |
| 7,757,933 | B2 | 7/2010 | Dunn |
| 7,806,314 | B2 | 10/2010 | Sutherland |
| 8,070,052 | B2 | 12/2011 | Spivey, Sr. et al. |
| 2002/0088820 | A1 | 7/2002 | Spivey |
| 2003/0136820 | A1 | 7/2003 | Negelen |
| 2003/0213263 | A1 | 11/2003 | Woog |
| 2004/0074954 | A1 | 4/2004 | Fogle et al. |
| 2005/0056658 | A1 | 3/2005 | Spivey |
| 2005/0167478 | A1 | 8/2005 | Holley, Jr. |
| 2006/0071058 | A1 | 4/2006 | Spivey, Sr. |
| 2006/0169755 | A1 | 8/2006 | Spivey, Sr. |
| 2006/0273143 | A1 | 12/2006 | Finch |
| 2007/0039846 | A1 | 2/2007 | Spivey, Sr. |
| 2007/0051781 | A1 | 3/2007 | Holley, Jr. |
| 2007/0108261 | A1 | 5/2007 | Schuster |
| 2007/0164091 | A1 | 7/2007 | Fogle et al. |
| 2007/0181658 | A1 | 8/2007 | Sutherland |
| 2007/0205255 | A1 | 9/2007 | Dunn |
| 2007/0284424 | A1 | 12/2007 | Holley |
| 2007/0295789 | A1 | 12/2007 | Ho Fung |
| 2008/0073420 | A1 | 3/2008 | Walling et al. |
| 2008/0083820 | A1 | 4/2008 | Walling et al. |
| 2008/0119344 | A1 | 5/2008 | Sutherland et al. |
| 2009/0236408 | A1 | 9/2009 | Spivey, Sr. |
| 2009/0255983 | A1 | 10/2009 | De Paula et al. |
| 2010/0213249 | A1 | 8/2010 | Requena |
| 2012/0321754 | A1 | 12/2012 | Block |

FOREIGN PATENT DOCUMENTS

| | | | |
|---|---|---|---|
| CA | 2 160 145 | | 9/1995 |
| CH | 601064 | | 6/1978 |
| DE | 85 14 718.4 | | 6/1985 |
| DE | 296 07 374 | | 4/1996 |
| DE | 296 13 814 | U1 | 10/1996 |
| DE | 201 12 228 | | 11/2002 |
| DE | 2004 018 649 | | 4/2005 |
| EP | 3935 | | 9/1979 |
| EP | 0412226 | | 2/1991 |
| EP | 0473 266 | | 3/1992 |
| EP | 1 612 157 | | 1/2006 |
| FR | 1 489 093 | | 6/1967 |
| FR | 1 494 239 | | 9/1967 |
| FR | 2 274 059 | | 1/1976 |
| FR | 2 579 175 | | 9/1986 |
| GB | 2 252 958 | | 8/1992 |
| KR | 20-0356729 | | 7/2004 |
| WO | WO 96/21604 | | 7/1996 |
| WO | WO 96/27538 | | 9/1996 |
| WO | WO 98/19932 | | 5/1998 |
| WO | WO 99/28207 | | 6/1999 |
| WO | WO 00/78618 | | 12/2000 |
| WO | WO 01/66434 | | 9/2001 |
| WO | WO 03/037742 | | 5/2003 |
| WO | WO 2005/080218 | | 9/2005 |
| WO | WO 2005/123532 | | 12/2005 |
| WO | WO 2007/089282 | | 8/2007 |
| WO | WO 2009/117562 | A1 | 9/2009 |

* cited by examiner

CARTON WITH HANDLE

CROSS-REFERENCE TO RELATED APPLICATIONS

This application is a continuation application of PCT/US2011/051897, filed Sep. 16, 2011, which application claims the benefit of U.S. Provisional Patent Application No. 61/403,549, filed Sep. 17, 2010.

INCORPORATION BY REFERENCE

The disclosures of PCT/US2011/051897, which was filed on Sep. 16, 2011, and U.S. Provisional Patent Application No. 61/403,549, which was filed on Sep. 17, 2010, are hereby incorporated by reference for all purposes as if presented herein in their entirety.

BACKGROUND OF THE DISCLOSURE

The present disclosure generally relates to cartons for holding containers. More specifically, the present disclosure relates to a carton having a handle.

SUMMARY OF THE DISCLOSURE

In one aspect, the present disclosure is generally directed to a carton for containing a plurality of articles. The carton comprises a plurality of panels that extends at least partially around an interior of the carton. The plurality of panels comprises a first top panel, a second top panel, a bottom panel, a first side panel, and a second side panel. The first top panel and the second top panel are at least partially overlapped to form a top wall of the carton. A handle extends in at least the top wall. The handle can comprise at least a first handle portion of the first top panel and a second handle portion of the second top panel. The first handle portion can at least partially overlap the second handle portion, and the second handle portion can comprise a notch that is at least partially overlapped by a overlay portion of the first handle portion.

In another aspect, the disclosure is generally directed to a blank for forming a carton. The blank can comprise a plurality of panels comprising a first top panel, a second top panel, a bottom panel, a first side panel, and a second side panel. The first top panel and the second top panel are for being at least partially overlapped to form a top wall in the carton formed by the blank. The blank further comprises handle features for forming a handle in at least the top wall in the carton formed by the blank. The handle features can comprise at least a first handle portion of the first top panel and a second handle portion of the second top panel. The first handle portion is for being positioned to at least partially overlap the second handle portion when the carton is formed from the blank, and the second handle portion can comprise a notch that is for being at least partially overlapped by a overlay portion of the first handle portion when the carton is formed from the blank.

In another aspect, the disclosure is generally directed to a method of assembling a carton. The method can comprise obtaining a blank comprising a plurality of panels comprising a first top panel, a second top panel, a bottom panel, a first side panel, and a second side panel, and handle features comprising at least a first handle portion of the first top panel and a second handle portion of the second top panel. The second handle portion comprises a notch and the first handle portion comprises a overlay portion. The method further comprises forming an interior of the carton at least partially defined by the plurality of panels and forming a top wall comprising at least the first top panel and the second top panel. The forming the top wall comprises overlapping at least a portion of the second top panel with at least a portion of the first top panel. The overlapping at least a portion of the second top panel with at least a portion of the first top panel comprises at least partially overlapping the second handle portion of the second top panel with the first handle portion of the first top panel to form a handle extending in at least the top wall. The at least partially overlapping at least the second handle portion with the first handle portion comprises at least partially overlapping the notch of the second handle portion with the overlay portion of the first handle portion.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present invention generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., aluminum beverage cans) as disposed within the carton embodiments. In this specification, the terms "lower," "bottom," "upper" and "top" indicate orientations determined in relation to fully erected and upright cartons.

Figure 1:
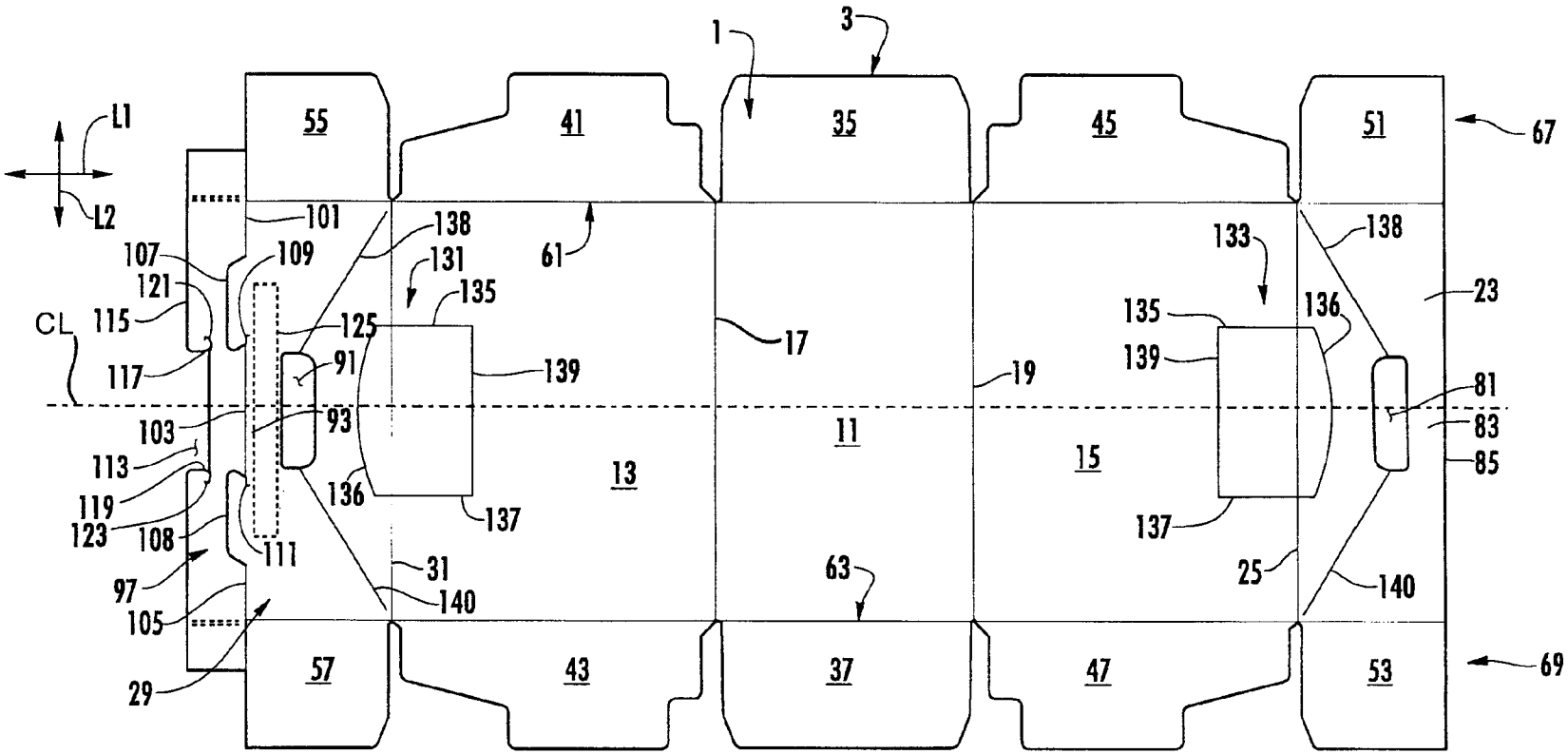
FIG. 1 is an exterior plan view of a blank for forming a carton according to a first exemplary embodiment of the disclosure.

FIG. 1 is a plan view of the exterior side 1 of a blank, generally indicated at 3, used to form a carton 5 (FIG. 9) according to one exemplary embodiment of the disclosure. The carton 5 can be used to house a plurality of articles such as containers (not shown). The carton 5 has a handle, generally indicated at 7 (FIGS. 5-9), for grasping and carrying the carton. In one illustrated embodiment, the carton 5 is sized to house thirty containers in two layers in a 3×5 arrangement, but it is understood that the carton may be sized and shaped to hold containers of a different or same quantity in a single layer, more than two layers, and/or in different row/column arrangements (e.g., 1×6, 3×6, 2×6, 4×6, 2×6×2, 3×4×2, 2×9, etc.). In the illustrated embodiment, the containers are cans, but other types of containers (e.g., bottles) can be used in the carton 5.

The blank 3 has a longitudinal axis L1 and a lateral axis L2. The blank 3 comprises a bottom panel 11 foldably connected to first and second side panels 13, 15 at lateral fold lines 17, 19, a first top panel 23 foldably connected to the second side panel 15 at a lateral fold line 25, and a second top panel 29 foldably connected to the first side panel 13 at a lateral fold line 31. The first and second top panels 23, 29 will at least partially overlap in the erected carton 5.

The bottom panel 11 is foldably connected to a first bottom end flap 35 and a second bottom end flap 37. The first side panel 13 is foldably connected to a first side end flap 41 and a second side end flap 43. The second side panel 15 is foldably connected to a first side end flap 45 and a second side end flap 47. The first top panel 23 is foldably connected to a first top end flap 51 and a second top end flap 53. The second top panel 29 is foldably connected to a third top end flap 55 and a fourth top end flap 57.

The end flaps 35, 41, 45, 51, 55 extend along a first marginal area of the blank 3, and are foldably connected at a first longitudinal fold line 61 that extends along the length of the blank. The end flaps 37, 43, 47, 53, 57 extend along a second marginal area of the blank 3, and are foldably connected at a second longitudinal fold line 63 that also extends along the length of the blank. The longitudinal fold lines 61, 63 may be, for example, substantially straight, offset, or oblique at one or more locations to account for blank thickness or for other factors. When the carton 5 is erected, the end flaps 35, 41, 45, 51, 55 close a first end 67 of the carton, and the end flaps 37, 43, 47, 53, 57 close a second end 69 of the carton. In accordance with an alternative embodiment of the present invention, different flap arrangements can be used for closing the ends 67, 69 of the carton 5.

Figure 2:
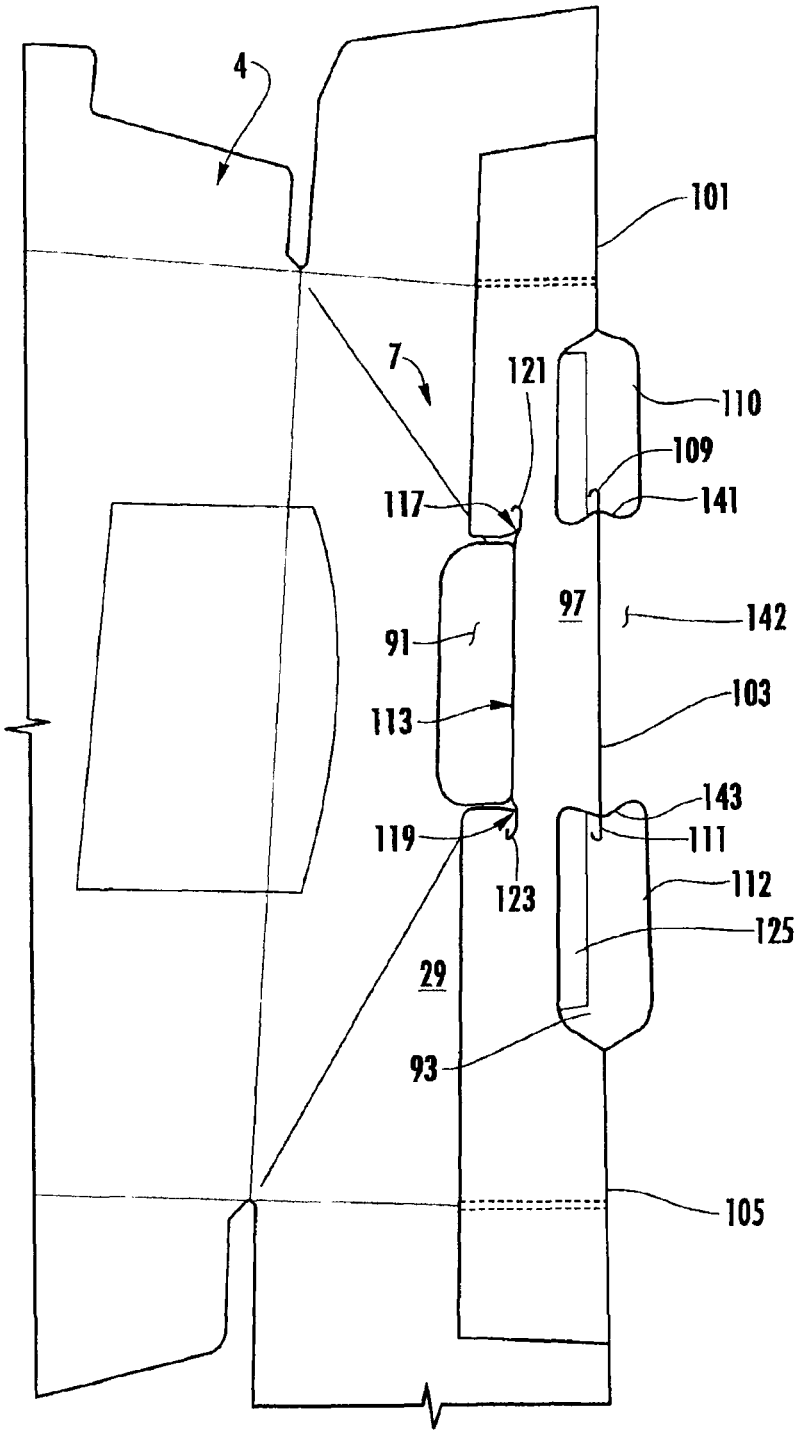
FIG. 2 is an interior view of a partially assembled carton according to the first embodiment of the disclosure.

The features that comprise the handle 7 include a first handle opening 81 that is in the first top panel 23 and a first handle portion 83 that is in the first top panel adjacent to the first handle opening and a laterally-extending edge 85 of the blank 3. The features that comprise the handle 7 also comprise a second handle opening 91 in the second top panel 29 and a second handle portion 93 that is in the second top panel adjacent to the second handle opening. In one embodiment, the handle features comprise a handle reinforcement flap 97 foldably connected to the second top panel 29. The handle reinforcement flap 97 is foldably connected to the second top panel 29 at three lateral fold lines 101, 103, 105. The handle reinforcement flap 97 is at least partially defined by a first cut 107 between the lateral fold lines 101, 103 and a second cut 108 between the lateral fold lines 103, 105. In the illustrated embodiment, the cuts 107, 108 can form projections 110, 112 (FIGS. 2-4) extending from the second top panel 93 when the handle reinforcement flap 97 is folded along fold lines 101, 103, 103 (FIG. 2). In the embodiment of FIG. 1, respective hook-shaped cuts 109, 111 extend from respective ends of the lateral fold line 103 and at least partially define the projections 110, 112.

In the embodiment of FIG. 1, the handle reinforcement flap 97 has a cutout 113 at a laterally extending edge 115 of the blank 3. The cutout 113 can be generally aligned with the handle openings 83, 91 along a longitudinal centerline CL of the blank 3. In one embodiment, the cutout 113 is generally rectangular with two notches 117, 119 at the two longitudinally inward corners of the cutout. The handle reinforcement flap 97 can have respective hook cuts 121, 123 that extend from a respective notch 117, 119. The handle reinforcement flap 97 could be otherwise shaped, arranged, and/or configured and could have a cutout 113 that is alternatively shaped and/or arranged without departing from the disclosure.

Figure 1A:
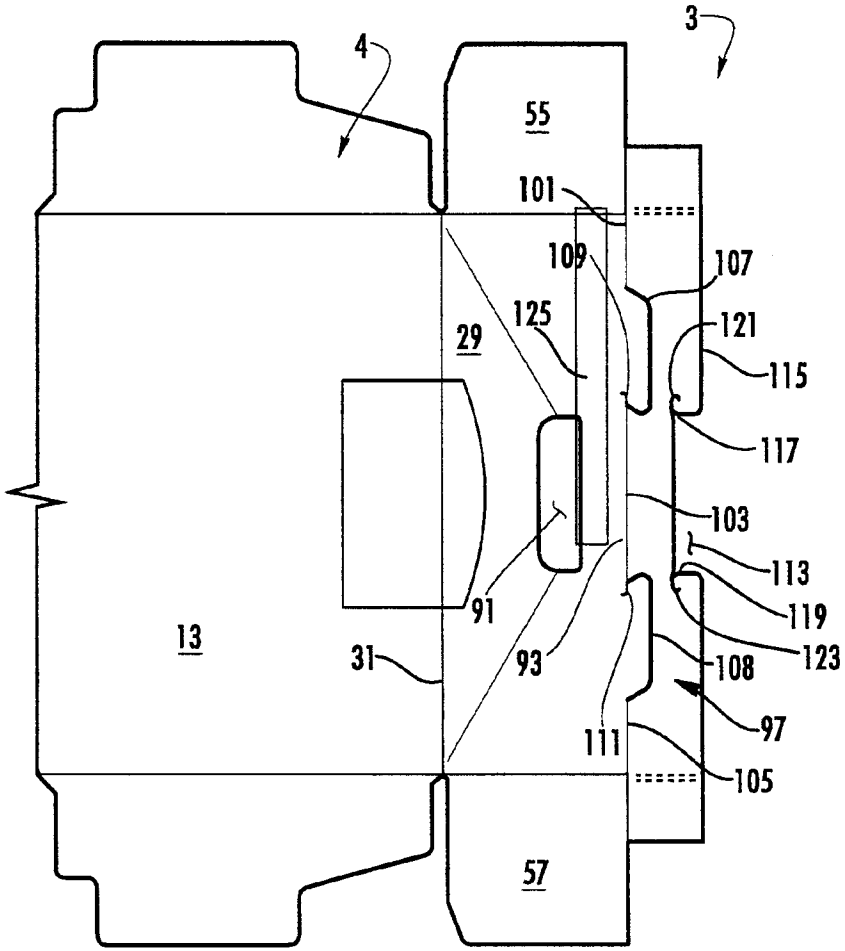
FIG. 1A is an interior plan view of a portion of the blank of FIG. 1.

In one embodiment, the handle 7 includes reinforcement tape 125 that can be adhesively applied to the interior surface of the handle portion 93 of the second top panel 29 and/or other portions of the second top panel (FIG. 1A). Alternatively, the reinforcement tape 125 can be applied to at least the first handle portion 83 of the first top panel 23 and/or to the handle reinforcement flap 97. Alternatively, the reinforcement tape 125 can be replaced by adhesive such as glue or other reinforcing material. Further, the reinforcement tape 125 could be omitted without departing from this disclosure.

In the illustrated embodiment, the blank 3 comprises stress-relieving areas or patterns 131, 133. The stress relieving patterns 131, 133 each comprise longitudinal score lines 135, 137, a lateral score line 139 connecting respective ends of the longitudinal score lines in the first and second side panels 13, 15, a curved score line 136 connecting respective ends of the longitudinal score lines in the first and second top panel 23, 29, and oblique score lines 138, 140 extending from a respective handle opening 81, 91 in a respective top panel. In one embodiment, the score lines of each of the stress-relieving areas 131, 133 are four point crease/score lines that extend deeper into the thickness of the blank 3 than the score lines forming the fold lines 17, 19, 25, 31, 61, 63. The specific depth of the score lines of the stress-relieving areas 131, 133 can vary but should be generally proportional to the weight or thickness of the material of the blank 3.

Figure 3:
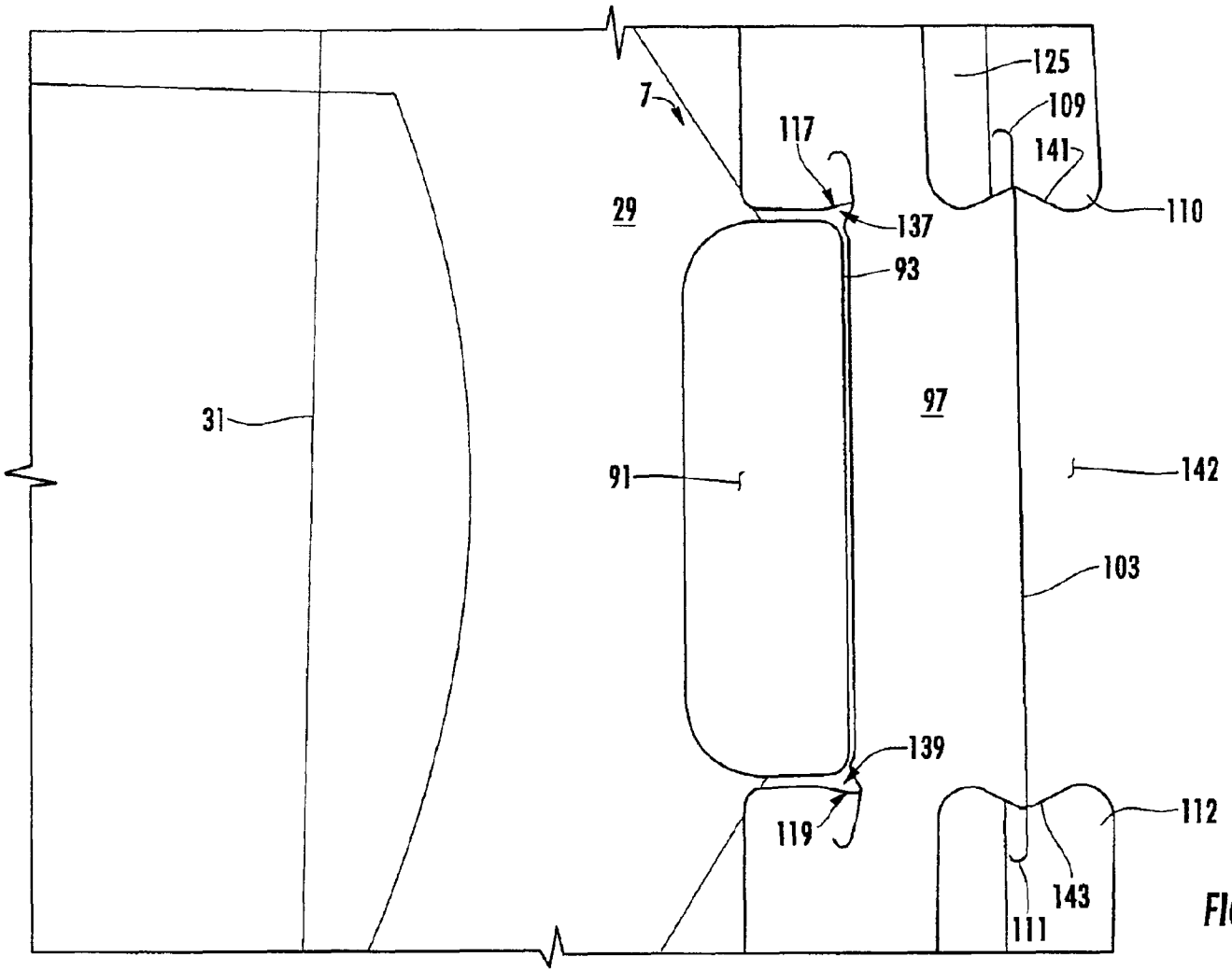
FIG. 3 is a interior detail view of the partially assembled carton of FIG. 2.

An exemplary method of erecting the carton 5 is discussed in detail below and shown in FIGS. 1A-6. At various stages of the erecting process, glue or other adhesive can be applied to various portions of the blank 3. As shown in FIG. 1A, the blank 3 is first positioned with the exterior surface 1 facing down and the interior surface 4 facing up (opposite from the position shown in FIG. 1 with the exterior surface facing up). The reinforcement tape 125 can be placed on the second top panel 29. Next, the handle reinforcement flap 97 is folded about fold lines 101, 103, 105 to be in face-to-face contact with the reinforcement tape 125 and the second top panel 29 (FIG. 2). As shown in FIGS. 2 and 3, the notches 117, 119 are positioned so that respective overlay portions 137, 139 of the handle portion 93 of the second top panel 29 overlap the notches.

Figure 4:
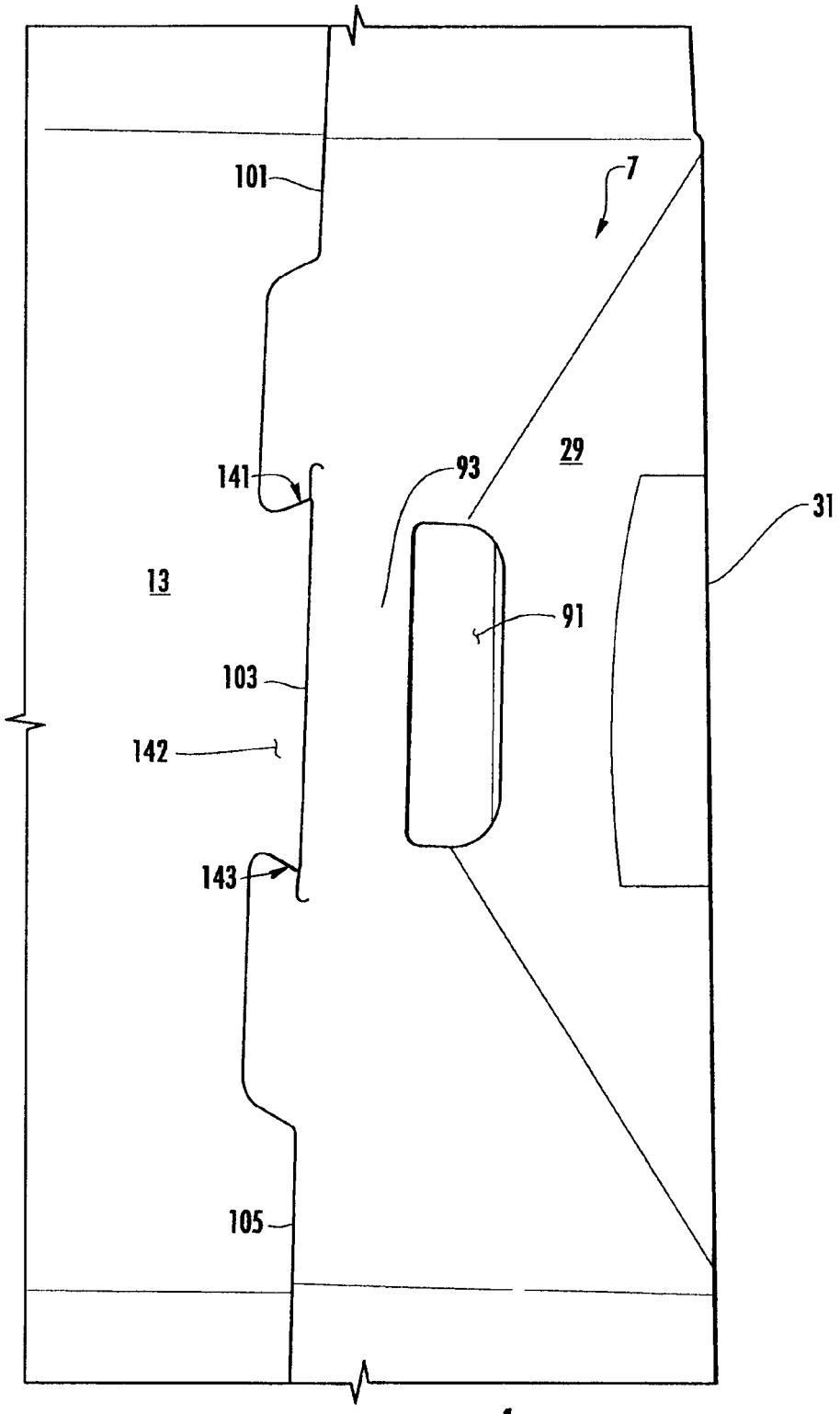
FIG. 4 is a plan view of a partially assembled carton that is further assembled according to the first embodiment of the disclosure.

As shown in FIGS. 2-4, when the reinforcement flap 97 is folded about fold lines 101, 103, 105, the projections 110, 112 are formed at the respective cut lines 107, 108 with a recess 142 extending between the curved edges of the projections 110, 112 and along the fold line 103. Notches 141, 143 in the handle portion 93 are formed in respective corners of the recess 142 that are similar in shape as the notches 117, 119 in the reinforcement flap. The notches 141, 143 are defined by at least the curved edges of the projections 110, 112 and the edge formed at the fold line 103, and the hook-cuts 109, 111 extend from the notches 141, 143. In the illustrated embodiment, the notches 141, 143 are defined by the respective curved edges of the projections 110, 112 and the fold line 103 when the handle reinforcement flap 97 is folded into face-to-face contact with the second top panel 29. However, the notches 143, 143 can be considered to be defined by the respective curved portions of the cut lines 107, 108 and the fold line 103 in the blank 3 before the handle reinforcement flap 97 is folded.

Figure 5:
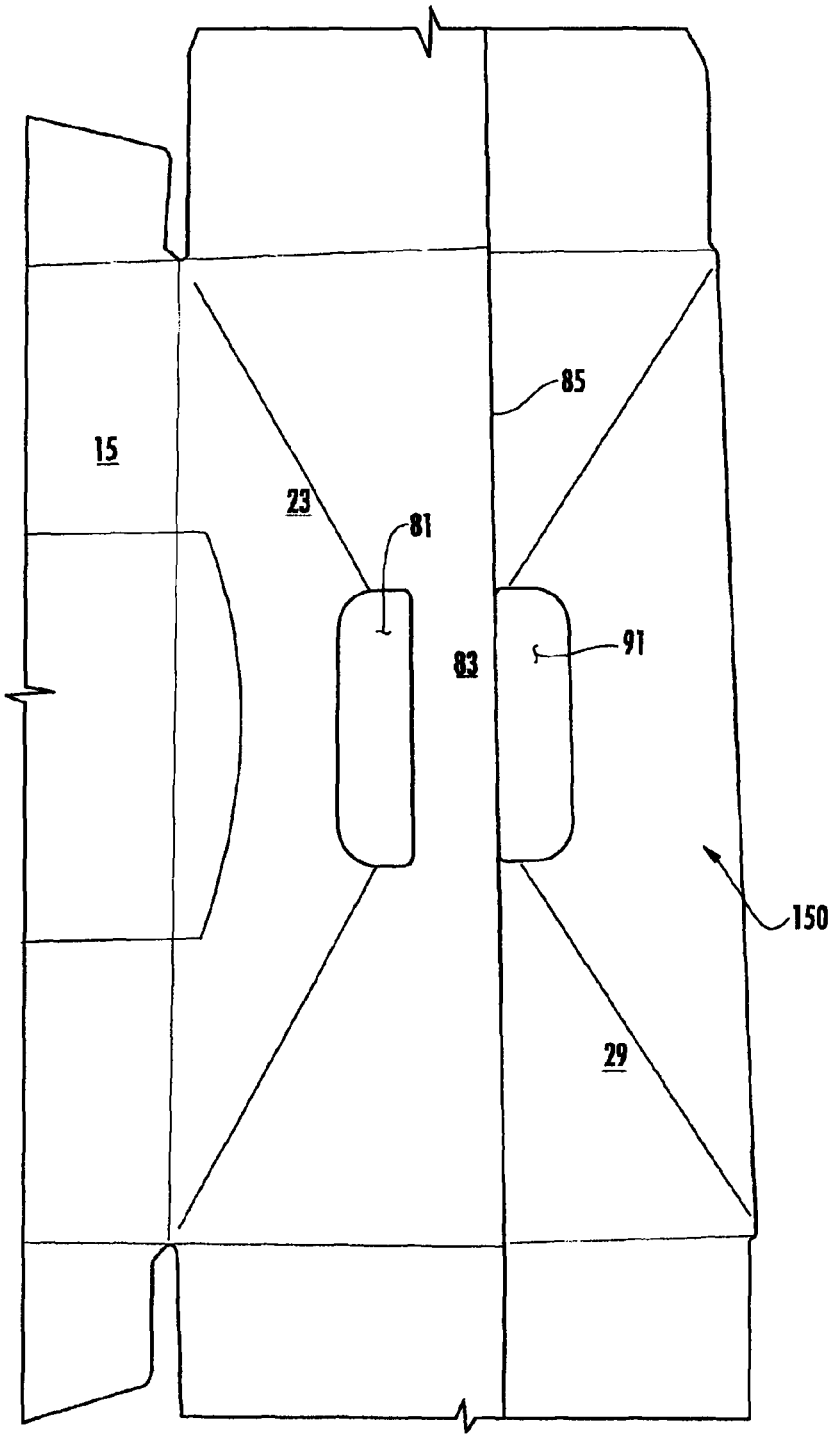
FIG. 5 is an exterior top view of a partially assembled carton that is further assembled according to the first embodiment of the disclosure.
Figure 6:
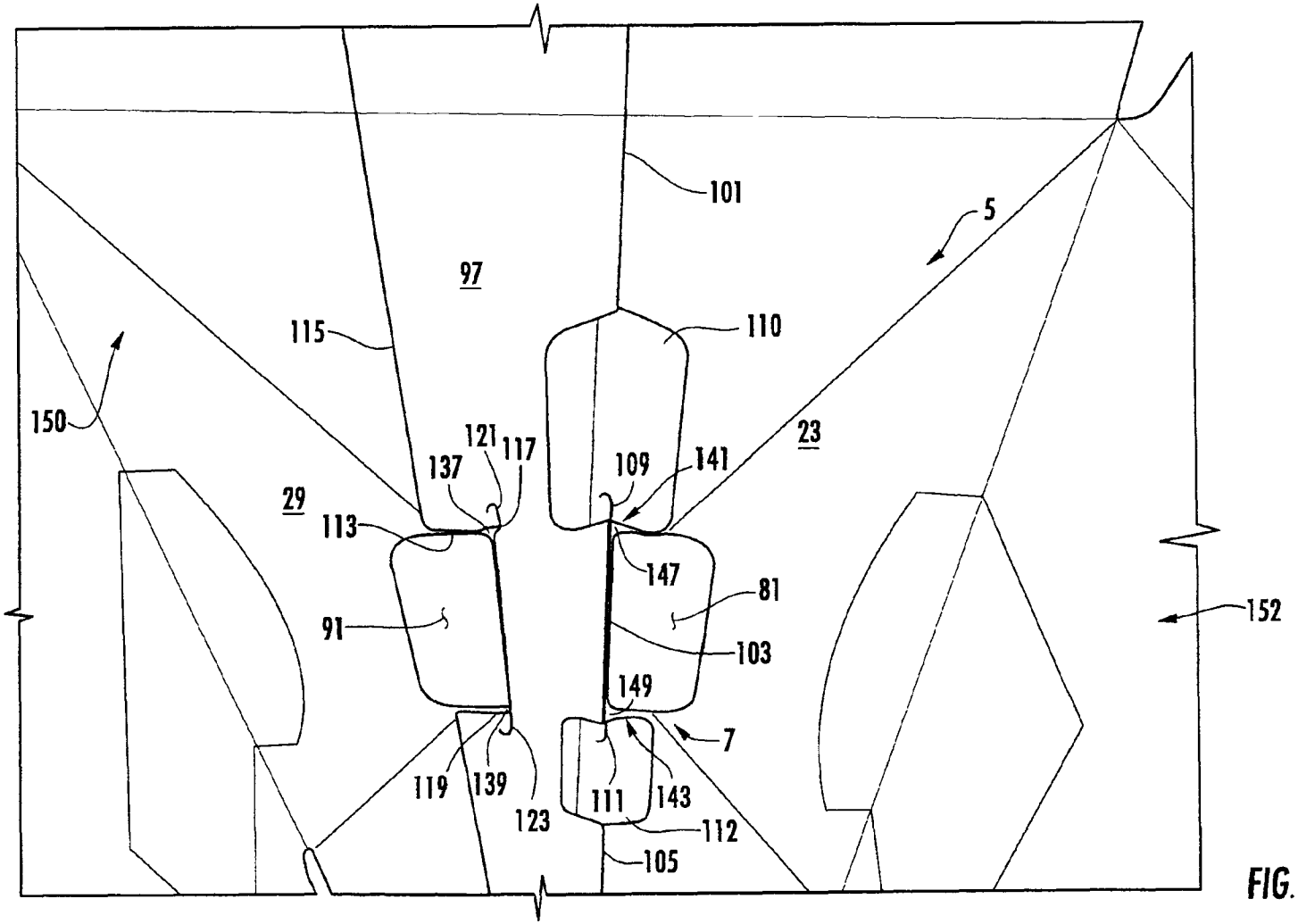
FIG. 6 is an interior view of a top wall of a partially assembled carton that is further assembled according to the first embodiment of the disclosure.
Figure 7:
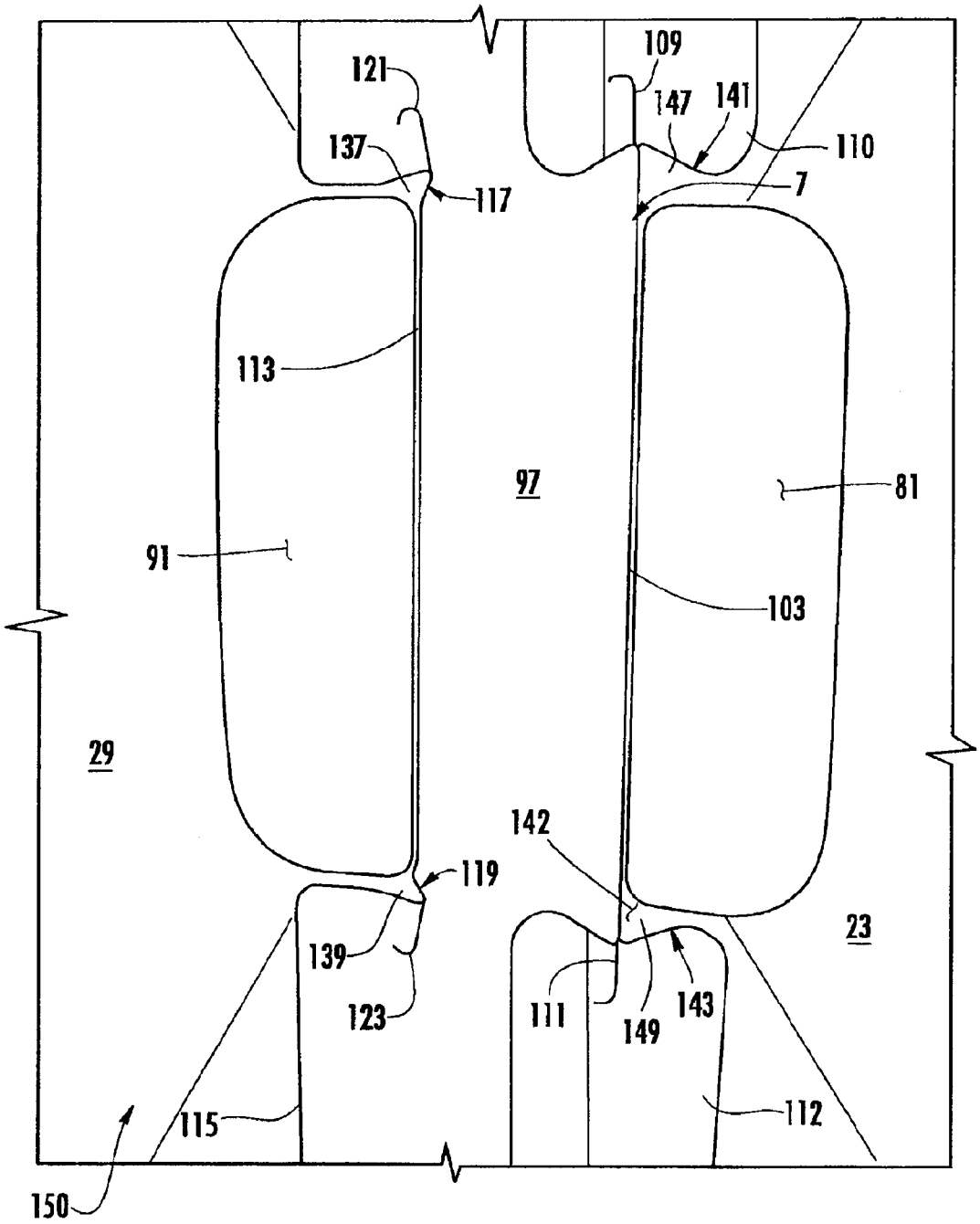
FIG. 7 is an interior detail view of a handle of the carton according to the first embodiment of the disclosure.
Figure 8:
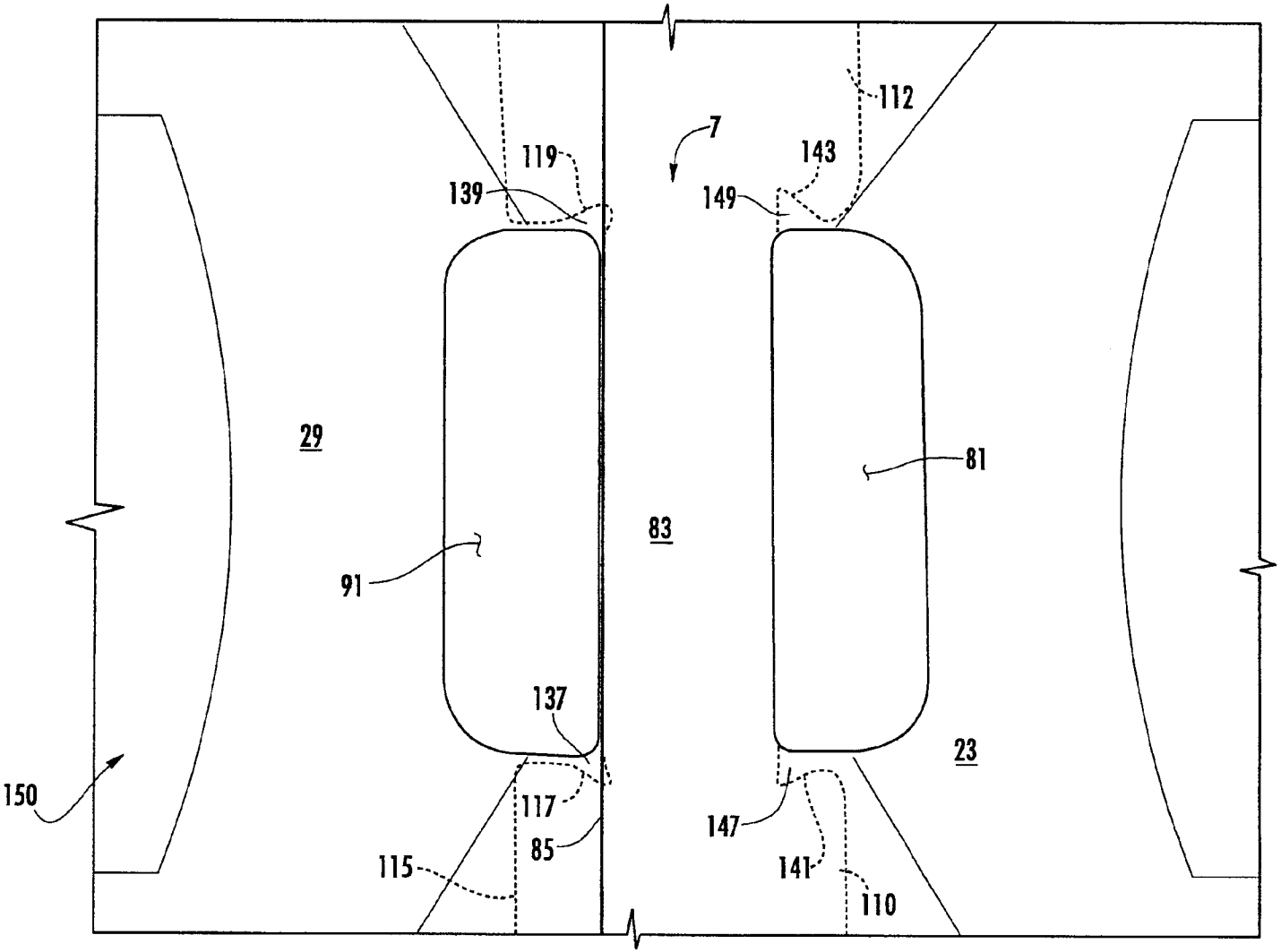
FIG. 8 is a top view showing the exterior of the handle of the carton according to the first embodiment of the disclosure.
Figure 9:
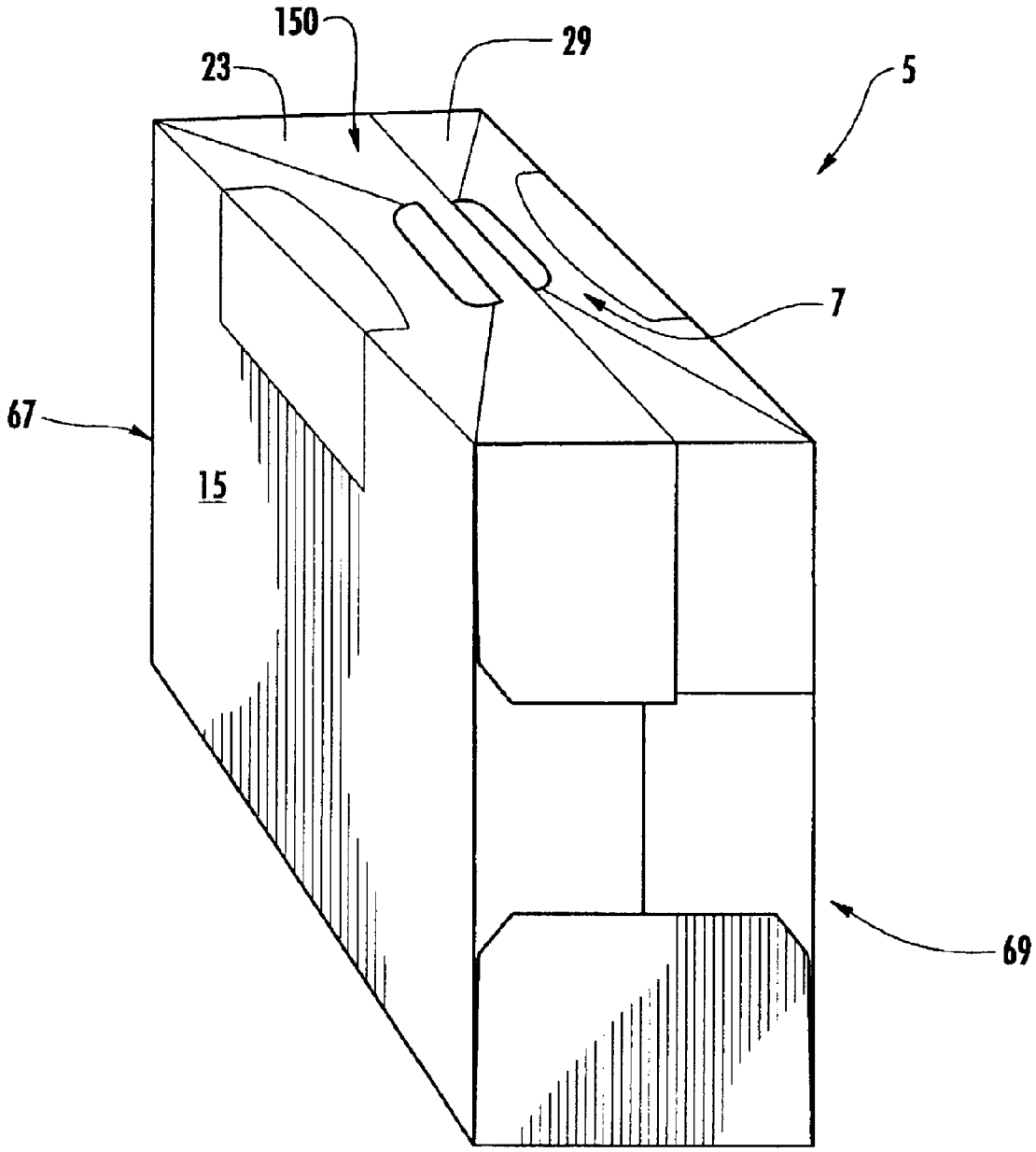
FIG. 9 is a perspective view of the carton 5 according to the first embodiment of the disclosure.

In one embodiment, the carton 5 is further formed by folding the second top panel 29, with the folded under and attached reinforcement flap 97, about fold line 31 to the position shown in FIG. 4. Adhesive such as glue can be applied to the exterior surface of the handle portion 93 and/or other portions of the second top panel 29. Next, the blank 3 can be folded about fold line 19 so that the first top panel 23 at least partially overlaps and is adhesively secured to the second top panel 29 to form a top wall 150 (FIG. 5). In one embodiment, the handle portion 83 of the first top panel 23 overlaps and is adhesively secured to the handle portion 93 of the second top panel 29 to form the handle 7 (FIG. 5). FIG. 6 shows the top wall 150 and the handle 7 from the interior 152 of the partially assembled carton. FIG. 7 shows the interior of the handle 7. FIG. 8 is a top view of the carton 5 showing the exterior of the handle 7. In FIG. 8, the notches 141, 143 and the projections 110, 112 of the second handle portion 93 are obscured by the first top panel 23, and the notches 117, 119 and the laterally extending edge 115 of the handle reinforcement flap 97 are obscured by the second top panel 29. Accordingly the notches 117, 119, 141, 143, the projections 110, 112, and the edge 115 are shown in phantom in FIG. 8. As shown in FIGS. 7 and 8, overlay portions 147, 149 of the handle portion 83 of the first top panel 23 overlap the respective notches 141, 143. In one embodiment, the overlay portions 147, 149 can be adjacent respective corners of the handle opening 81 in the first top panel 23.

In the illustrated embodiment, the overlay portions 137, 139 of the second top panel in combination with the respective notches 117, 119 of the handle reinforcement flap 97 form respective weakened portions of the handle 7 that are adjacent respective corners of the handle opening 91 and the cutout 113. The overlay portions 147, 149 of the first top panel 23 in combination with the respective notches 141, 143 of the second top panel 29 form respective weakened portions of the handle that are adjacent respective corners of the handle opening 81 and the recess 142. When the carton 5 is loaded, assembled, and closed, the handle 7 is activated by grasping the handle at the handle openings 81, 91. When the erected carton 5 carton is lifted, small tears may occur in the overlay portions 137, 139, 147, 149 that are directed generally inward toward the overlapped handle portions 83, 93 and reinforcement flap 97. The strength of the overlapped handle portions 83, 93, reinforcement flap 97, and reinforcement tape 125 in the central portion of the handle 7 stops the tears formed in the weakened areas at the overlay portions 137, 139, 147, 149 from propagating throughout the carton 5. The hook-shaped cuts 109, 111, 121, 123 can also help control and direct tearing in and proximate the handle 7. In this way, the handle 7 is strengthened (e.g., the tearing of the handle is controlled) by the use of the hook-shaped cuts 109, 111, 121, 123 and/or the weakened areas at the overlay portions 137, 139, 147, 149, which are controlled by the shape of the respective notches 117, 119, 141, 143. Accordingly, the notches 117, 119, 141, 143 can provide directed potential tearing in predictable areas. The overlay portions 137, 139, 147, 149 are less reinforced than portions of the handle that are adjacent the notches 117, 119, 141, 143. The notches 117, 119, 141, 143, hook-shaped cuts 109, 111, 121, 123, and overlay portions 137, 139, 147, 149 could be otherwise shaped, arranged, and/or configured without departing from the disclosure. For example, the hook-shaped cuts 109, 111, 121, 123 can be configured so that the lateral portions of the cuts in the illustrated embodiment are oblique or longitudinal. Further, the hook-shaped cuts can be positioned so that the curved portions are otherwise directed (e.g., the curved portions are all directed toward the center of the handle 7).

The partially assembled blank can be assembled into an open-ended sleeve so that containers can be loaded into the sleeve. After loading the containers, the ends 67, 69 of the carton 5 can be closed by at least partially overlapping and adhering the end flaps 35, 41, 45, 51, 55 at the first end 67 of the carton and at least partially overlapping and adhering the end flaps 37, 43, 47, 53, 57 at the second end 69 of the carton. The overlapped top end flaps at each end (e.g., 53, 57 at end 69) are downwardly folded and secured to the side end flaps (e.g., 43, 47) at the same end. The bottom end flap (e.g., 37) can be upwardly folded and secured to the side end flaps (e.g., 43, 47) at the same end. The ends 67, 69 of the carton 5 could be closed by other closing steps and features without departing from the disclosure. Further, the carton 5 can be alternatively loaded, such as by loading the containers after closing either of the ends 67, 69.

In the illustrated embodiment, the handle 7 is formed from the handle features of the blank and comprises three layers of blank material (first handle portion 83, second handle portion 93, and reinforcement flap 97). Additionally, the reinforcement tape 125 acts as an additional layer of material between the handle portion 93 and the reinforcement flap 97. The handle 7 could have other features and could include additional reinforcing layers or portions without departing from the disclosure. The reinforced handle 7 of the present disclosure allows the blank 3 to be made of a relatively thinner material (e.g., material with a 21 caliper thickness) compared to a blank for forming the same size carton that will need an increased thickness (e.g., 24 caliper thickness) to maintain the integrity of the handle when carried.

Figure 10:
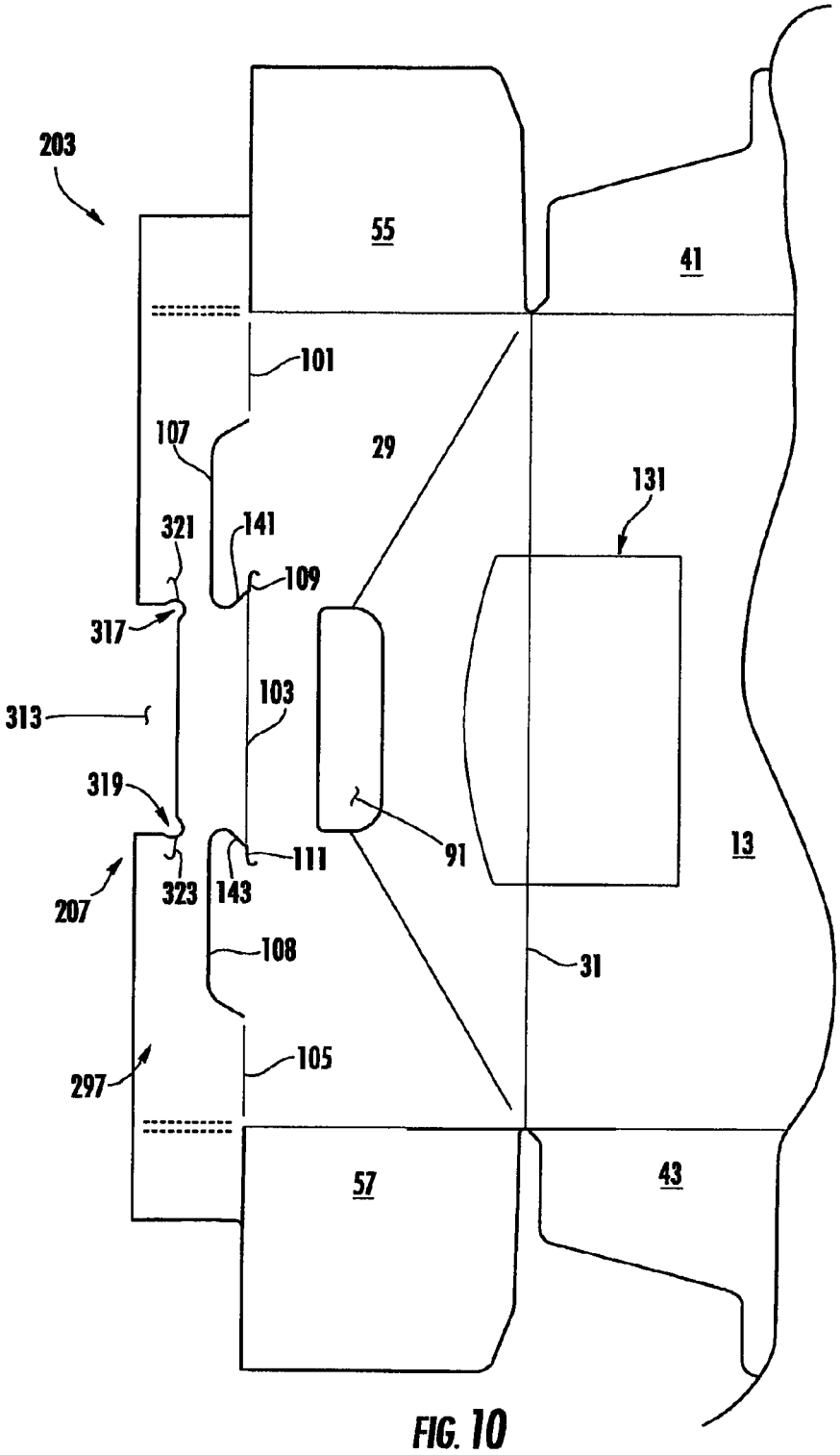
FIG. 10 is an exterior plan view of a blank for forming a carton according to a second embodiment of the disclosure.

According to a second embodiment of the disclosure, FIG. 10 is a plan view of a carton blank 203 that is similar to the first embodiment with like or similar features having like or similar reference numbers. In the embodiment of FIG. 10, the handle reinforcement flap 297 includes a cutout 313 with notches 317, 319 disposed in respective corners of the cutout. The notches 317, 319 can be alternatively shaped, for example, to have a generally semicircular shape. As shown in FIG. 10, hook-shaped cuts 321, 323 extend from the edges of the respective notches 317, 319. The notches 141, 143 in the second top panel 29 also can be alternatively shaped without departing from the disclosure. The notches and corresponding overlay portions or weakened areas in the handle 207 could be otherwise shaped, arranged, and/or configured without departing from the disclosure.

Figure 11:
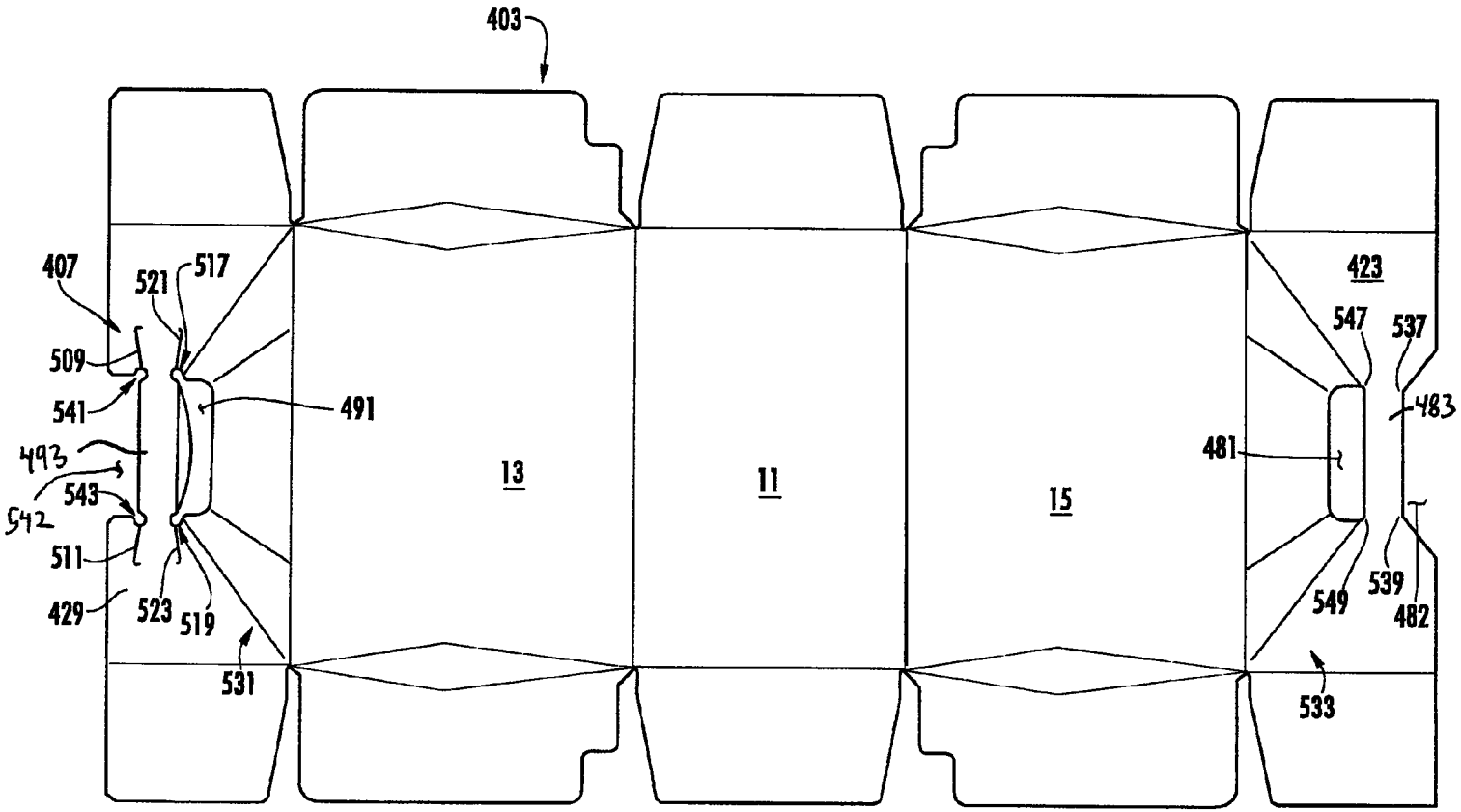
FIG. 11 is an exterior plan view of a blank for forming a carton according to a third embodiment of the disclosure.

According to a third embodiment of the disclosure, FIG. 11 is a plan view of a third embodiment of a carton blank 403 that is similar to the first embodiment with like or similar features having like or similar reference numbers. In the embodiment of FIG. 11, the handle reinforcement flap 97 is omitted. The second top panel 429 has notches 541, 543 formed in the respective corners of a recess 542 in the free edge of the second top panel. Notches 517, 519 are formed in respective corners of the handle opening 491 on the opposite side of the second handle portion 493. The notches 517, 519 are generally aligned with the respective notches 541, 543. The notches 517, 519, 541, 543 can have a generally semicircular shape, as shown by way of example in FIG. 11. Hook-shaped cut 509, 511, 521, 523 can extend in the second top panel 429 from the respective notches 541, 543, 517, 519. In the embodiment of FIG. 11, the first top panel includes handle opening 481, 482 on either side of the handle portion 483. The handle opening 482 can be a recess in the free edge of the first top panel 423. Overlay portions 537, 539, 547, 549 at respective corners of the handle openings 482, 481 overlap the respective notches 517, 519, 541, 543 to form weakened areas in the handle that is formed by the overlapping top panels 423, 429 when the carton is formed from the blank 403. As shown in FIG. 11, the blank 403 can include alternative stress relieving patterns 531, 533 extending in the respective top panels 429, 423. Additionally, a reinforcement tape (not shown) can be secured to one or both of the handle portions 483, 493. The recesses, handle openings, notches, hook-shaped cuts, and corresponding weakened areas in the handle 407 could be otherwise shaped, arranged, and/or configured without departing from the disclosure.

Figure 12:
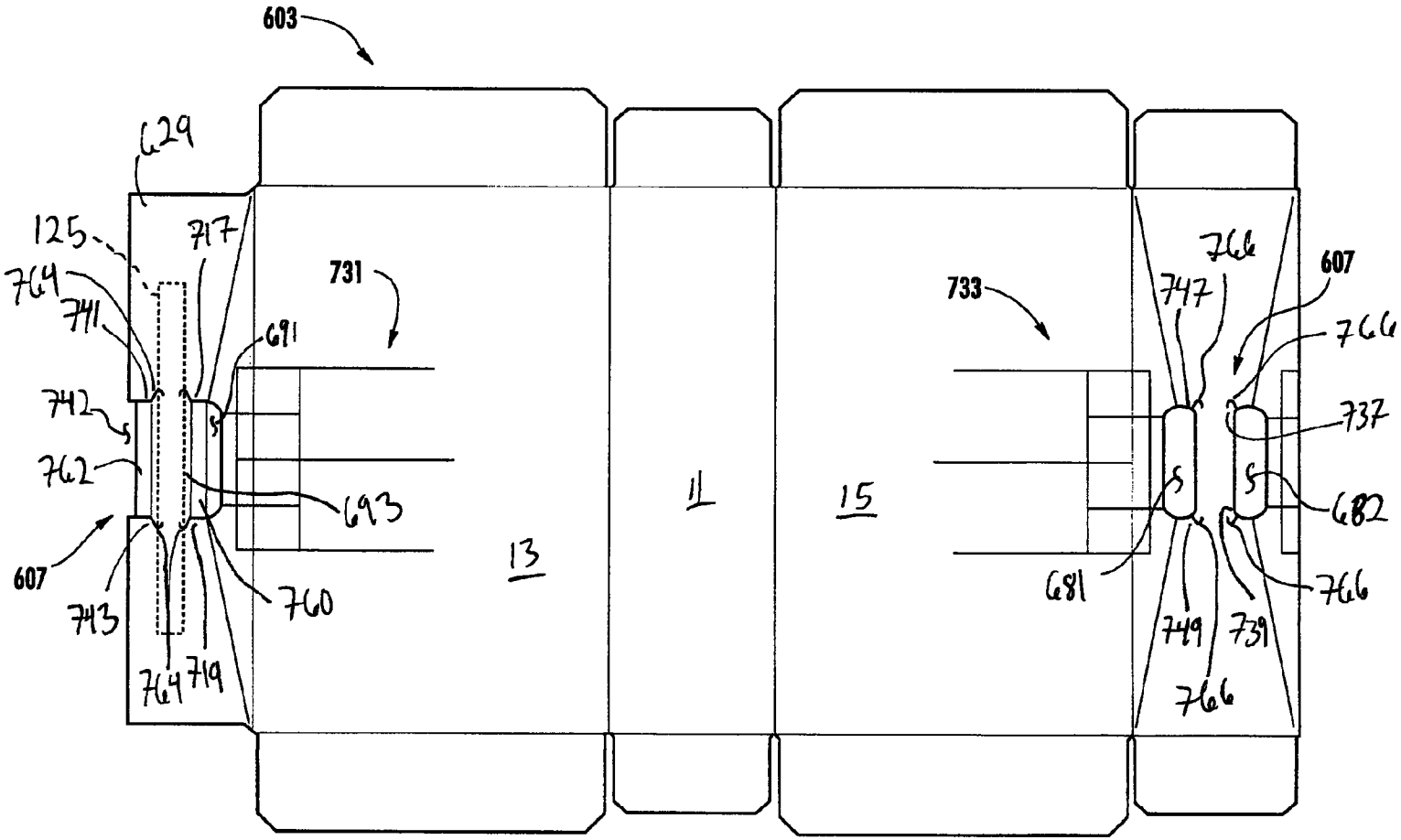
FIG. 12 is an exterior plan view of a blank for forming a carton according to a third embodiment of the disclosure.

According to a fourth embodiment of the disclosure, FIG. 12 shows a carton blank 603 that is similar to the third embodiment with like or similar features having like or similar reference numbers. In the embodiment of FIG. 12, the end flaps of the second top panel 629 are omitted, and the second top panel includes handle flaps 760, 762 foldably connected to the handle portion 693 in the respective handle opening 691 and recess 742. Notches 717, 719 741, 743 are formed in respective corners of the handle opening 691 and recess 742 when the handle flaps 760, 762 are folded out of the plane of the second top panel 629. The notches 717, 719 741, 743 can be alternatively shaped, for example, to be generally square for forming correspondingly shaped or weakened areas in combination with respective overlay portions 737, 739, 747, 749 in the first top panel 623. The overlay portions 737, 739, 747, 749 are in respective corners of the handle openings 682, 681. Hook-shaped cuts 764 can extend from each of the notches 717, 719 741, 743. In one embodiment, hook-shaped cuts 766 can also extend from each of the overlay portions 737, 739, 747, 749 in the first top panel 623. Further, the stress-relief areas 731, 733 are alternatively shaped. The notches, corresponding weakened areas in the handle 607, and stress-relief areas could be otherwise shaped, arranged, and/or configured without departing from the disclosure.

Any of the features of the various embodiments of the disclosure can be combined with, replaced by, or otherwise configured with other features of other embodiments of the disclosure without departing from the scope of this disclosure. Further, it is noted that the handle features and stress-relief areas of the various embodiments can be incorporated into a carton having any carton style or panel configuration. The carton styles and panel configurations described above are included by way of example.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

In accordance with the exemplary embodiment of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue. The term "glue" is intended to encompass all manner of adhesives commonly used to secure carton panels or flaps in place.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels that extends at least partially around an interior of the carton, the plurality of panels comprising a first top panel, a second top panel, a bottom panel, a first side panel, and a second side panel, the first top panel and the second top panel being at least partially overlapped to form a top wall of the carton; and a handle extending in at least the top wall, the handle comprising at least a first handle portion of the first top panel and a second handle portion of the second top panel, the first handle portion at least partially overlapping the second handle portion, the second handle portion comprising a notch that is at least partially overlapped by an overlay portion of the first handle portion, wherein the notch is at least partially defined by a notch edge of the second top panel, and the overlay portion of the first handle portion of the first top panel extends over the notch beyond the notch edge of the second top panel.

2. The carton of claim 1, further comprising a projection extending from the second handle portion, wherein the notch is at least partially defined by a curved edge of the projection.

3. The carton of claim 2, wherein a hook-shaped cut extends in the second handle portion from the notch.

4. The carton of claim 2, wherein:

the notch of the second handle portion is a first notch, the projection of the second handle portion is a first projection, the curved edge of the projection is a first curved edge of the first projection, and the overlay portion of the first handle portion is a first overlay portion;

the second handle portion comprises a second notch spaced apart from the first notch and at least partially overlapped by a second overlay portion of the first handle portion; and the second notch is at least partially defined by a second curved edge of a second projection extending from the second handle portion.

5. The carton of claim 4, further comprising a handle reinforcement flap foldably connected to the second handle portion of the second top panel, wherein at least the second handle portion at least partially overlaps the handle reinforcement flap.

6. The carton of claim 5, wherein the handle reinforcement flap is foldably connected to the second handle portion along at least a fold line extending from the first notch to the second notch, the fold line defining at least a portion of each of the first notch and the second notch.

7. The carton of claim 5, wherein:

the handle reinforcement flap comprises a cutout;

the handle reinforcement flap comprises a third notch disposed at a first corner of the cutout and a fourth notch disposed at a second corner of the cutout, the third notch being spaced apart from the first notch and generally aligned with the first notch, and the fourth notch being spaced apart from the second notch and generally aligned with the second notch; and the second handle portion of the second top panel comprises a third overlay portion and a fourth overlay portion, the third overlay portion at least partially overlapping the third notch in the handle reinforcement flap and the fourth overlay portion at least partially overlapping the fourth notch in the handle reinforcement flap.

8. The carton of claim 7, wherein a hook-shaped cut extends in the second handle portion from each of the first notch and the second notch, and a hook-shaped cut extends in the handle reinforcement flap from each of the third notch and the fourth notch.

9. The carton of claim 7, wherein the second handle portion comprises a recess extending between the first curved edge of the first projection and the second curved edge of the second projection, the first notch and the second notch being generally disposed in respective corners of the recess.

10. The carton of claim 9, wherein:

the first handle portion comprises a first handle opening extending in the first top panel and generally aligned with the recess of the second handle portion;

the first overlay portion and the second overlay portion of the first handle portion are disposed generally adjacent to respective corners of the first handle opening;

the second handle portion comprises a second handle opening extending in the second top panel and generally aligned with the cutout of the handle reinforcement flap; and the third overlay portion and the fourth overlay portion of the second handle portion are disposed generally adjacent to respective corners of the second handle opening.

11. The carton of claim 10, wherein a free edge of the first handle portion overlays at least a portion of the second handle portion, and at least a portion of the free edge of the first handle portion extends adjacent the second handle opening in the second handle portion.

12. The carton of claim 7, further comprising a reinforcement tape applied to at least one of the first handle portion and the second handle portion, at least a portion of the reinforcement tape extending between the first handle opening and the second handle opening.

13. The carton of claim 1, wherein:

the notch of the second handle portion is a first notch and the overlay portion of the first handle portion is a first overlay portion;

the second handle portion comprises a second notch spaced apart from the first notch and at least partially overlapped by a second overlay portion of the first handle portion;

the second handle portion comprises a recess adjacent a free edge of the second top panel, the first notch being generally disposed in a corner of the recess; and the second handle portion comprises a handle opening spaced apart from the recess, the second notch being generally disposed in a corner of the handle opening.

14. The carton of claim 13, wherein:

the handle opening of the second handle portion is a first handle opening, and the first top panel comprises a second handle opening and a third handle opening, the second handle opening being generally aligned with the recess of the second handle portion, and the third handle opening being generally aligned with the first handle opening;

the first overlay portion of the first handle portion is disposed generally adjacent to a corner of the second handle opening in the first handle portion; and the second overlay portion of the first handle portion is disposed generally adjacent to a corner of the third handle opening in the first handle portion.

15. The carton of claim 14, wherein:

the second handle portion comprises a third notch and a fourth notch, the third notch being spaced apart from the first notch and generally disposed in an opposing corner of the recess of the second handle portion, and the fourth notch being spaced apart from the second notch and generally disposed in an opposing corner of the first handle opening of the second handle portion; and the first handle portion comprises a third overlay portion and a fourth overlay portion, the third overlay portion at least partially overlapping the third notch in the second handle portion, and the fourth overlay portion at least partially overlapping the fourth notch in the second handle portion.

16. The carton of claim 15, wherein a hook-shaped cut extends in the second handle portion from each of the first notch, the second notch, the third notch, and the fourth notch, and the carton further comprises a reinforcement tape applied to at least one of the first handle portion or the second handle portion, at least a portion of the reinforcement tape extending between the recess and the first handle opening of the second handle portion.

17. The carton of claim 1, further comprising a handle reinforcement flap foldably connected to the second handle portion of the second top panel along at least a fold line extending from the notch, the fold line defining at least a portion of the notch.

18. A blank for forming a carton for holding a plurality of containers, the blank comprising:

a plurality of panels comprising a first top panel, a second top panel, a bottom panel, a first side panel, and a second side panel, the first top panel and the second top panel for being at least partially overlapped to form a top wall in the carton formed by the blank; and handle features for forming a handle in at least the top wall in the carton formed by the blank, the handle features comprising at least a first handle portion of the first top panel and a second handle portion of the second top panel, the first handle portion for being positioned to at least partially overlap the second handle portion when the carton is formed from the blank, the second handle portion comprising a notch that is for being at least partially overlapped by an overlay portion of the first handle portion when the carton is formed from the blank, wherein the second top panel comprises a notch line that at least partially forms a notch edge of the second top panel when the carton is formed from the blank, the notch is at least partially defined by the notch edge, and the overlay portion of the first handle portion of the first top panel is for extending over the notch beyond the notch edge of the second top panel when the overlay portion overlaps the notch in the carton formed from the blank.

19. The blank of claim 18, wherein the second top panel comprises a projection that is at Least partially defined by a cut line, and the notch is at least partially defined by a curved portion of the cut line.

20. The blank of claim 19, wherein a hook-shaped cut extends in the second handle portion from the notch.

21. The blank of claim 19, wherein:

the notch of the second handle portion is a first notch, the projection of the second handle portion is a first projection, and the overlay portion of the first handle portion is a first overlay portion;

the second handle portion comprises a second notch spaced apart from the first notch, the second notch is for being at least partially overlapped by a second overlay portion of the first handle portion in the carton formed from the blank;

the second top panel comprises a second projection that is at least partially defined by a second cut line; and the second notch is at least partially defined by a curved portion of the second cut line.

22. The blank of claim 21, further comprising a handle reinforcement flap foldably connected to the second handle portion of the second top panel, wherein the handle reinforcement flap is for being at least partially overlapped by at least the second handle portion in the carton formed from the blank.

23. The blank of claim 22, wherein the handle reinforcement flap is foldably connected to the second handle portion along at least a fold line extending from the first notch to the second notch, the fold line defining at least a portion of each of the first notch and the second notch.

24. The blank of claim 22, wherein:

the handle reinforcement flap comprises a cutout;

the handle reinforcement flap comprises a third notch disposed at a first corner of the cutout and a fourth notch disposed at a second corner of the cutout, the third notch being spaced apart from the first notch and generally aligned with the first notch, and the fourth notch being spaced apart from the second notch and generally aligned with the second notch; and the second handle portion of the second top panel comprises a third overlay portion and a fourth overlay portion, the third overlay portion being for at least partially overlapping the third notch in the handle reinforcement flap and the fourth overlay portion at least partially overlapping the fourth notch in the handle reinforcement flap in the carton formed from the blank.

25. The blank of claim 24, wherein a hook-shaped cut extends in the second handle portion from each of the first notch and the second notch, and a hook-shaped cut extends in the handle reinforcement flap from each of the third notch and the fourth notch.

26. The blank of claim 24, wherein:

the first handle portion comprises a first handle opening extending in the first top panel;

the first overlay portion and the second overlay portion of the first handle portion are disposed generally adjacent to respective corners of the first handle opening;

the second handle portion comprises a second handle opening extending in the second top panel; and the third overlay portion and the fourth overlay portion of the second handle portion are disposed generally adjacent to respective corners of the second handle opening.

27. The blank of claim 24, further comprising a reinforcement tape applied to at least one of the first handle portion and the second handle portion.

28. The blank of claim 18, wherein:

the notch of the second handle portion is a first notch and the overlay portion of the first handle portion is a first overlay portion;

the second handle portion comprises a second notch spaced apart from the first notch, the second notch is for being at least partially overlapped by a second overlay portion of the first handle portion in the carton formed from the blank;

the second handle portion comprises a recess adjacent a free edge of the second top panel, the first notch being generally disposed in a corner of the recess; and the second handle portion comprises a handle opening spaced apart from the recess, the second notch being generally disposed in a corner of the handle opening.

29. The blank of claim 28, wherein:

the handle opening of the second handle portion is a first handle opening, and the first top panel comprises a second handle opening and a third handle opening;

the first overlay portion of the first handle portion is disposed generally adjacent to a corner of the second handle opening in the first handle portion; and the second overlay portion of the first handle portion is disposed generally adjacent to a corner of the third handle opening in the first handle portion.

30. The blank of claim 29, wherein:

the second handle portion comprises a third notch and a fourth notch, the third notch being spaced apart from the first notch and generally disposed in an opposing corner of the recess of the second handle portion, and the fourth notch being spaced apart from the second notch and generally disposed in an opposing corner of the first handle opening of the second handle portion; and the first handle portion comprises a third overlay portion and a fourth overlay portion, the third overlay portion being for at least partially overlapping the third notch in the second handle portion, and the fourth overlay portion being for at least partially overlapping the fourth notch in the second handle portion.

31. The blank of claim 30, wherein a hook-shaped cut extends in the second handle portion from each of the first notch, the second notch, the third notch, and the fourth notch, and the blank further comprises a reinforcement tape applied to at least the second handle portion, at least a portion of the reinforcement tape extending between the recess and the first handle opening of the second handle portion.

32. The blank of claim 18, further comprising a handle reinforcement flap foldably connected to the second handle portion of the second top panel along at least a fold line extending from the notch, the fold line defining at least a portion of the notch when the carton is formed from the blank.

33. A method of forming a carton, the method comprising:

obtaining a blank comprising a plurality of panels comprising a first top panel, a second top panel, a bottom panel, a first side panel, and a second side panel, and handle features comprising at least a first handle portion of the first top panel and a second handle portion of the second top panel, the second handle portion comprising a notch and the first handle portion comprising an overlay portion, wherein the notch is at least partially defined by a notch edge of the second top panel;

forming an interior of the carton at least partially defined by the plurality of panels;

forming a top wall comprising at least the first top panel and the second top panel by overlapping at least a portion of the second top panel with at least a portion of the first top panel;

wherein the overlapping at least a portion of the second top panel with at least a portion of the first top panel comprises at least partially overlapping the second handle portion of the second top panel with the first handle portion of the first top panel to form a handle extending in at least the top wall, the at least partially overlapping at least the second handle portion with the first handle portion comprising at least partially overlapping the notch of the second handle portion with the overlay portion of the first handle portion so that the overlay portion of the first handle portion of the first top panel extends over the notch beyond the notch edge of the second top panel.

34. The method of claim 33, wherein:

the notch of the second handle portion is a first notch and the overlay portion of the first handle portion is a first overlay portion;

the second handle portion comprises a second notch spaced apart from the first notch, and the first handle portion comprises a second overlay portion; and the at least partially overlapping at least the second handle portion with the first handle portion further comprises at least partially overlapping the second notch with the second overlay portion.

35. The method of claim 34, wherein the blank further comprises a handle reinforcement flap foldably connected to the second handle portion of the second top panel, and the method further comprises at least partially overlapping the handle reinforcement flap with at least the second handle portion.

36. The method of claim 35, wherein:

the handle reinforcement flap comprises a cutout;

the handle reinforcement flap comprises a third notch disposed at a first corner of the cutout and a fourth notch disposed at a second corner of the cutout, the third notch being spaced apart from the first notch and generally aligned with the first notch, and the fourth notch being spaced apart from the second notch and generally aligned with the second notch;

the second handle portion of the second top panel comprises a third overlay portion and a fourth overlay portion; and the at least partially overlapping the handle reinforcement flap with at least the second handle portion comprises at least partially overlapping the third notch in the handle reinforcement flap with the third overlay portion and at least partially overlapping the fourth notch in the handle reinforcement flap with the fourth overlay portion.

37. The method of claim 35, wherein:

the handle reinforcement flap is foldably connected to at least the second handle portion of the second top panel at a fold line;

the at least partially overlapping the handle reinforcement flap with at least the second handle portion comprises folding the handle reinforcement flap along the fold line;

the folding the handle reinforcement flap along the fold line forms a recess in the second top panel; and the first notch and the second notch are generally disposed in respective corners of the recess.

38. The method of claim 33, wherein:

the notch of the second handle portion is a first notch and the overlay portion of the first handle portion is a first overlay portion;

the second handle portion comprises a second notch spaced apart from the first notch, and the first handle portion comprises a second overlay portion;

the at least partially overlapping at least the second handle portion with the first handle portion further comprises at least partially overlapping the second notch with the second overlay portion;

the second handle portion comprises a recess adjacent a free edge of the second top panel, the first notch being generally disposed in a corner of the recess; and the second handle portion comprises a handle opening spaced apart from the recess, the second notch being generally disposed in a corner of the handle opening.

39. The method of claim 38, wherein:

the second handle portion comprises a third notch and a fourth notch, the third notch being spaced apart from the first notch and generally disposed in an opposing corner of the recess of the second handle portion, and the fourth notch being spaced apart from the second notch and generally disposed in an opposing corner of the first handle opening of the second handle portion;

the first handle portion comprises a third overlay portion and a fourth overlay portion; and the at least partially overlapping at least the second handle portion with the first handle portion further comprises at least partially overlapping the third notch in the second handle portion with the third overlay portion and at least partially overlapping the fourth notch in the second handle portion with the fourth overlay portion.

40. The method of claim 33, further comprising a handle reinforcement flap foldably connected to the second handle portion of the second top panel along at least a fold line extending from the notch, the fold line defining at least a portion of the notch.

* * * * *